United States Patent [19]

Kahkipuro

[11] Patent Number: 5,027,925

[45] Date of Patent: Jul. 2, 1991

[54] PROCEDURE AND APPARATUS FOR DAMPING THE VIBRATIONS OF AN ELEVATOR CAR

[75] Inventor: Matti J. Kahkipuro, Hyvinkaa, Finland

[73] Assignee: Kone Elevator GmbH, Baar, Switzerland

[21] Appl. No.: 411,144

[22] Filed: Sep. 22, 1989

[30] Foreign Application Priority Data

Sep. 23, 1988 [FI] Finland ..... 884380

[51] Int. Cl.[5] ..... B66B 5/00

[52] U.S. Cl. ..... 187/115

[58] Field of Search ..... 187/115

[56] References Cited

U.S. PATENT DOCUMENTS 4,030,570 6/1977 Caputo ..... 187/115

4,271,931 6/1981 Watanabe ..... 187/115

FOREIGN PATENT DOCUMENTS 52-43246 4/1977 Japan ..... 187/115

*Primary Examiner*—A. D. Pellinen

*Assistant Examiner*—W. E. Duncanson, Jr.

*Attorney, Agent, or Firm*—Sughrue, Mion, Zinn, Macpeak & Seas

[57] ABSTRACT

A procedure for damping the vibrations of an elevator car or part supported by elastic suspension elements comprises the steps of measuring the acceleration of the elevator car or part by means of at least one acceleration transducer, using the output signal from that transducer to control at least one vibration damper, which, in order to damp a vibration, imparts to the elevator car or part a force acting in a direction opposite to the direction of the vibration and substantially simultaneous with it. An apparatus to carry out the procedure is also disclosed.

12 Claims, 2 Drawing Sheets

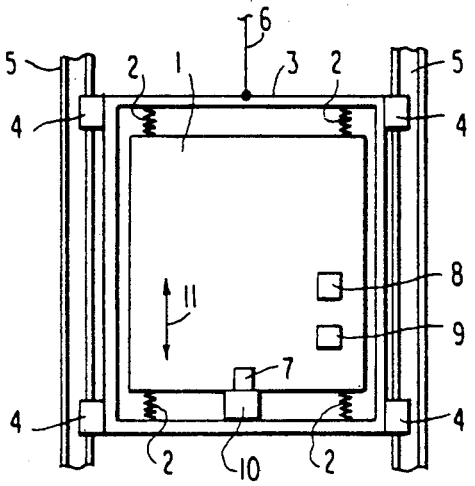
FIG. 1
FIG. 2
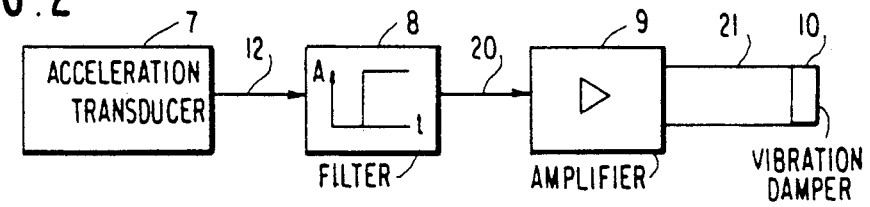
FIG. 3
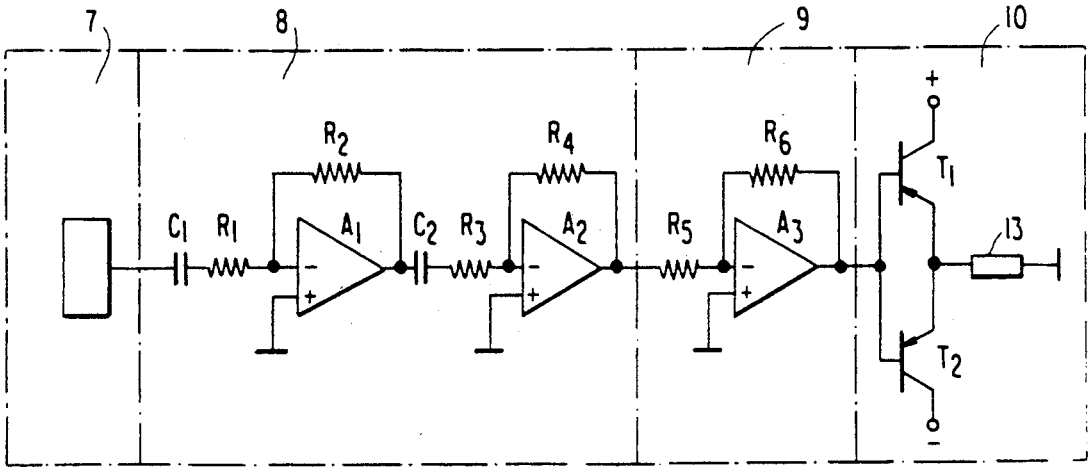

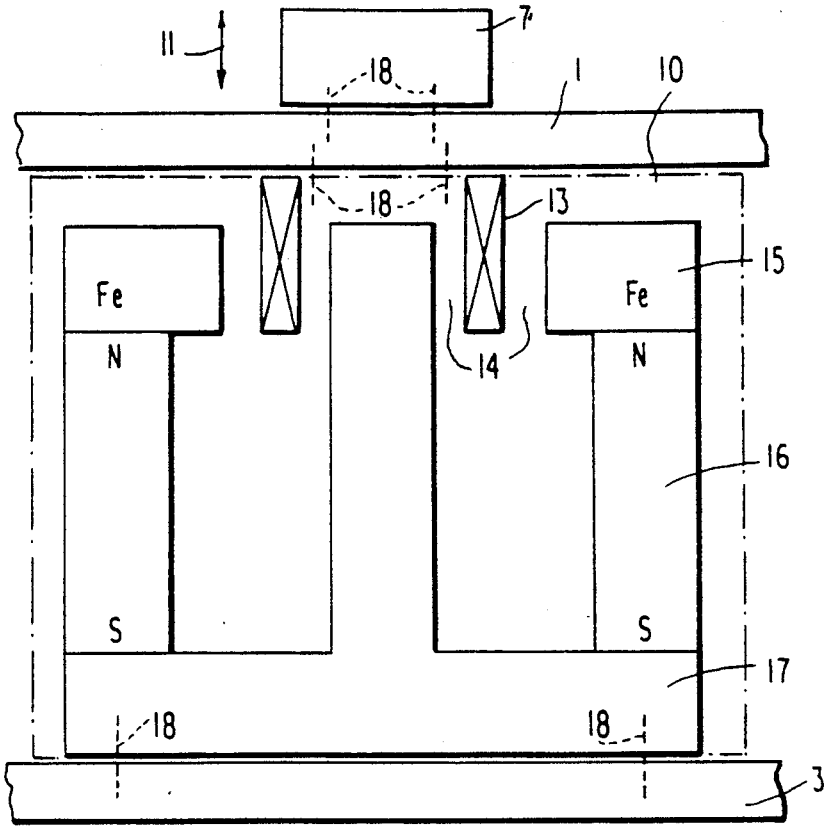
FIG. 4
FIG. 5
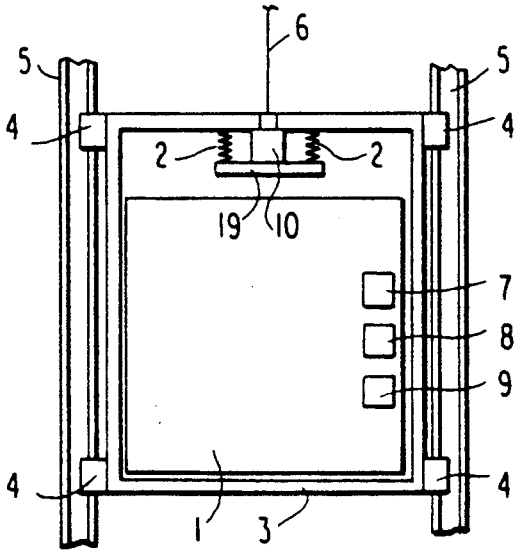

PROCEDURE AND APPARATUS FOR DAMPING THE VIBRATIONS OF AN ELEVATOR CAR

BACKGROUND OF THE INVENTION

1. Field of the Invention

The present invention relates to a procedure and apparatus for damping the vibrations of an elevator car or elevator car member supported by elastic suspension elements.

2. Description of Related Art

The degree of travelling comfort provided by an elevator is reduced by vibrations of the car. The vibrations induce unpleasant feelings in passengers and often result in undesirable noise.

Vibrations originating in the machine room of an elevator tend to be transmitted over the suspension ropes to the elevator car as vertical vibrations. The vibrations may be generated by sources like worn bearings of the machine, tooth wheels in the gear assembly or various auxiliary equipment such as tachometers.

In addition, electrical disturbances may generate oscillations in the elevator drive system. These oscillations may be transmitted as vertical vibrations via the motor, gear assembly, sheaves, pulleys and suspension rope to the elevator car. Moreover, horizontal vibrations caused e.g. by roughness of the guide rails, wear of the guide rollers or their bearings etc., may occur in the elevator car.

These undesirable vibrations of an elevator car typically have a frequency within the range from 1 Hz to 100 Hz and an amplitude of from 0.02 mm to 0.1 mm.

To damp undesirable vibrations, the rotating and sliding parts of the elevator machinery are manufactured to close tolerances, rotating parts are equilibrated and so on. Moreover, the elevator car may be insulated from the surrounding structures by using elastic suspension elements to support the car. All such arrangements are passive damping methods.

Active vibration damping systems are proposed in U.S. Pat. Nos. 4,030,580, 4,269,286 and 4,271,931. These employ a method whereby the elevator's speed reference is varied to damp the vibrations, the change in the speed reference being formed from the signal obtained from a tachometer installed in the elevator machine. However, the tachometer signal does not accurately represent the vibration of the elevator car, because e.g. vibrations caused by defects in diverter pulleys are not necessarily reflected in the tachometer signal.

Furthermore, a system based on varying the speed reference is best suited for damping car vibrations of a low frequency only, i.e. frequencies below 10 Hz, and is only applicable to the damping of vertical vibrations of the elevator car.

SUMMARY OF THE INVENTION

The object of the present invention is to eliminate the drawbacks referred to above and to achieve a procedure and apparatus for active damping of the vibrations occurring in an elevator car or in a part, e.g. the floor of an elevator car, including even higher vibration frequencies, within the range from approximately 1 Hz to approximately 100 Hz, regardless of the source, direction or location of the vibrations.

Accordingly, the present invention provides a procedure for damping the vibrations of an elevator car member, comprising the steps of supporting an elevator car by elastic suspension elements, measuring acceleration of the elevator member by means of at least one acceleration transducer, controlling at least one vibration damper with an output signal from said at least one acceleration transducer and imparting to the elevator car member a force acting in a direction opposite to the direction of the vibration and substantially simultaneous with it.

In preferred embodiments of the procedure of the invention signal components relating to the elevator's normal travelling acceleration or to changes in that acceleration are filtered out from the output signal of the at least one acceleration transducer.

In another preferred embodiment of the procedure of the invention at least one vibration damper is used in parallel with an elastic suspension arrangement.

A further preferred embodiment of the procedure of the invention provides that the signal obtained from the acceleration transducer is amplified before being input to the at least one vibration damper.

An apparatus designed for implementing the procedure of the invention provides in an elevator car supported by elastic suspension elements, an apparatus for damping the vibrations of an elevator car member, the apparatus comprising at least one acceleration transducer for measuring acceleration of the elevator car member, at least one vibration damper, for receiving an output signal from the at least one acceleration transducer and for damping vibration by imparting to the elevator car member a force acting in a direction opposite to the direction of the vibration and substantially simultaneous with it.

In a preferred embodiment of the apparatus designed for implementing the procedure of the invention the apparatus further comprises at least one high-pass filter in which the components relating to the elevator's normal travelling acceleration and changes in same are filtered out from the signal obtained from the at least one acceleration transducer.

Another preferred embodiment of the apparatus designed for implementing the procedure of the invention provides that the at least one vibration damper is mounted in parallel with the elastic suspension elements.

Yet another preferred embodiment of the apparatus designed for implementing the procedure of the invention provides that the apparatus comprises at least one amplifier for amplifying the output signal of the at least one acceleration transducer before input to the vibration damper.

A preferred embodiment of the apparatus designed for implementing the procedure of the invention provides that the at least one vibration damper consists of a coil-and-armature structure.

The procedure and apparatus of the invention allow active damping of vibrations of a relatively high frequency, i.e. from approximately 1 Hz to 100 Hz, appearing in an elevator car, such vibrations being difficult to suppress by other means. A good damping efficiency is achieved because the vibrations of the elevator car or elevator car member, e.g. the floor, are measured by at least one acceleration transducer attached directly to the car, e.g. the floor, and because the at least one vibration damper is attached directly to the object whose vibrations are to be damped, e.g. the floor of the elevator car. Although, by virtue of the precision of the manufacturing techniques and high quality of the materials used, the magnitude of vibrations in modern elevators is of a low order, it is possible, by using the apparatus of the invention, to produce an elevator in which the vibrations are still further reduced.

Moreover, because the apparatus of the invention is based on a simple procedure and the number of components required for the damping of vibrations is small, the apparatus is inexpensive. In addition, the elastic suspension of the elevator car can be implemented using cheap rubber shock absorbers, and the vibration dampers may, for example, be loudspeaker magnets, which, of course, are produced in large numbers.

BRIEF DESCRIPTION OF THE DRAWINGS

Further objects, features and advantages of the invention will become apparent from the following, with reference to the drawings attached, wherein:

FIG. 1 represents an apparatus for damping the vibrations of an elevator car as provided by the invention, the at least one vibration damper being mounted between the elevator car and the car sling (=supporting frame of the car), FIG. 2 is a block diagram illustrating the processing of the vibration signal, FIG. 3 shows an example of the circuit used in the apparatus of the invention, FIG. 4 illustrates the use of a loudspeaker magnet as a vibration damper and FIG. 5 represents an apparatus for damping the vertical vibrations of an elevator car, in which the vibration damper is mounted at the end of the suspension rope of the elevator.

DESCRIPTION OF THE PREFERRED EMBODIMENTS

FIG. 1 shows an apparatus for damping the vibrations of an elevator car as provided by the invention, in which at least one vibration damper is mounted between the elevator car and the car sling. The elevator car 1 is supported by the car sling by means of at least one elastic suspension element 2. The car sling 3 is supported by the suspension rope 6 and held steady between the elevator guide rails 5 by means of guides 4. The acceleration transducer 7 is mounted on the elevator car 1. The filter 8 and the amplifier 9 are also placed in the elevator car. At least one vibration damper 10 is placed in the space between the car 1 and the car sling 3, one side of each vibration damper 10 being attached to the car sling 3. Standard parts of elevator drive systems, such as the elevator machine, its motor, gear assembly, rope sheaves and auxiliary equipment like tachometers etc. are not shown in the figure. The filter and the amplifier, instead of being placed in the elevator car, can be located e.g. in the machine room, in which case the signals are transmitted via the car cable.

The elevator car or a part of it, e.g. the floor, is supported by the appropriate supporting elements by means of elastic suspension elements 2. The suspension allows a motion of the elevator car or a part of the elevator car, e.g. the floor, of a magnitude at least equal to the amplitude of the vibration, in the direction of the vibration.

The acceleration transducer 7 may be a device that detects the acceleration by electric means, or it may be a device, such as a load weighing device with a strain gauge placed in the elevator car, that gives an output signal from which the acceleration signal can be derived.

Vertical vibrations generated in the elevator machine room by the motor, gear assembly and auxiliary equipment are transmitted via the suspension rope 6 and guide rails 5 to the car sling 3 and further to the elevator car 1. Moreover, the guides 5 may produce vibrations that are transmitted to the car. The acceleration transducer 7 measures the vertical acceleration of the elevator car. The signal 12 obtained from the acceleration transducer contains both the vibration signals and the normal travelling acceleration signals.

The signal 12 provided by the acceleration transducer 7 is filtered as shown in FIG. 2 by a high-pass filter 8, which does not transmit low frequencies of the signal. The filter blocks the passage of signals relating to the normal travelling acceleration of the elevator and to control changes in the normal acceleration. Thus the damper will not try to correct the normal movements of the elevator. Vibration frequencies higher than 1 Hz are passed through the filter and absorbed by the damper.

The damping effect is based on the fact that the acceleration transducer is more sensitive than a human being. Therefore, the vibration remaining after damping is undetectable to the human senses.

The filtered signal 20 is amplified by the amplifier 9, from where the amplified signal 21, essentially simultaneous with and reversed in phase relative to the vibration signal, is fed into the vibration damper 10.

FIG. 3 shows the circuit used in the apparatus illustrated in FIG. 2. The circuit comprises capacitors $C_1$ and $C_2$, resistors $R_1$, $R_2$, $R_3$, $R_4$, $R_5$ and $R_6$, operational amplifiers $A_1$, $A_2$ and $A_3$ and transistors $T_1$ and $T_2$. In the filter 8, the signal supplied by the transducer 7 is filtered by the first capacitor $C_1$, whereupon it is amplified by the amplifier consisting of operational amplifier $A_1$ and resistors $R_1$ and $R_2$. Next, the signal is filtered by the second capacitor $C_2$ and amplified by the amplifier consisting of the second operational amplifier $A_2$ and resistors $R_3$ and $R_4$. Amplifier 9 consists of the third operational amplifier $A_3$ and resistors $R_5$ and $R_6$. The output stage consists of transistors $T_1$ and $T_2$ and coil 13.

FIG. 4 illustrates a coil-and-armature structure 13–17 of the type used e.g. in loudspeakers, serving here as a vibration damper 10. The coil 13 of the vibration damper 10 is attached to the elevator car 1 while its armature 17 is attached to the car sling 3. In FIGS. 1 and 4, the direction of vibration is represented by an arrow 11. When the coil 13 is activated as shown in FIGS. 2 and 3, it tends to move relative to the armature 17. Thus the damper 10 imparts to the elevator car 1 a force impulse which is reversed in direction relative to the direction 11 of the vibration and essentially simultaneous with it, thereby damping the vertical vibration of the elevator car.

It is obvious to a person skilled in the art that different embodiments of the invention are not restricted to the examples discussed above, but that they may instead be varied within the scope of the following claims.

It is also obvious to a person skilled in the art that the invention can be applied to damping vibrations occurring in any direction in an elevator car or a part, e.g. the floor, of an elevator car. To suppress vibrations in all three dimensions, three sets of equipment as provided by the invention are used simultaneously, though only the signal obtained from the transducer measuring the acceleration in the normal travelling direction of the elevator is filtered. The signals provided by the transducers measuring the acceleration in the other two directions need not be filtered. In this embodiment, the vibration damper must be able to sustain a motion perpendicular to its own direction of operation and of an amplitude corresponding to the amplitude of the vibration in the other direction. For example, when the vibration damper consists of a coil-and-armature structure as explained above, an air gap of sufficient width has to be provided between the coil and the armature.

It is equally obvious to a person skilled in the art that several sets of equipment as provided by the invention can be used in parallel. For example, to damp the vertical vibrations in an elevator having a large floor area, it is preferable to use four vibration dampers placed near the corners, each damper having its own acceleration transducer, filter and amplifier.

It is no less obvious to a person skilled in the art that the procedure and apparatus of the invention can also be applied in vibration damping systems arranged around the point of attachment of the suspension rope as shown in FIG. 5. In this figure, the elevator car 1 is fixedly mounted in the car sling 3. The suspension rope 6 is attached to a bar 19. Between the bar 19 and the car sling 3, elastic suspension elements 2 and a vibration damper 10 are provided. An acceleration transducer 7 is mounted on the elevator car 1. In other respects the car unit corresponds to that in FIG. 1.

I claim:

1. A procedure for damping the vibrations of an elevator car member, comprising the steps of supporting an elevator car by elastic suspension elements, measuring acceleration of the elevator member by means of at least one acceleration transducer, controlling at least one vibration damper with an output signal from said at least one acceleration transducer and imparting to the elevator car member a force acting in a direction opposite to the direction of the vibration and substantially simultaneous with the vibration, and wherein the at least one vibration damper is used in parallel with the elastic suspension elements.

2. A procedure according to claim 1, further comprising the step of amplifying the signal obtained from the at least one acceleration transducer before inputting it to the at least one vibration damper.

3. A procedure for damping the vibrations of an elevator car member, comprising the steps of supporting an elevator car by elastic suspension elements, measuring acceleration of the elevator member by means of at least one acceleration transducer, controlling at least one vibration damper with an output signal from said at least one acceleration transducer and imparting to the elevator car member a force acting in a direction opposite to the direction of the vibration and substantially simultaneous with the vibration, wherein signal components relating to the elevator's normal travelling acceleration are filtered out from the output signal of said at least one acceleration transducer and wherein the at least one vibration damper is used in parallel with the elastic suspension elements.

4. A procedure for damping the vibrations of an elevator car member, comprising the steps of supporting an elevator car by elastic suspension elements, measuring acceleration of the elevator member by means of at least one acceleration transducer, controlling at least one vibration damper with an output signal from said at least one acceleration transducer and imparting to the elevator car member a force acting in a direction opposite to the direction of the vibration and substantially simultaneous with the vibration, wherein signal components relating to the elevator's normal travelling acceleration are filtered out from the output signal of said at least one acceleration transducer, wherein signal components relating to changes in the elevators normal travelling acceleration are filtered out from the output signal of the at least one transducer, and wherein the at least one vibration damper is used in parallel with the elastic suspension elements.

5. In an elevator car supported by elastic suspension elements, an apparatus for damping the vibrations of an elevator car member, the apparatus comprising at least one acceleration transducer for measuring acceleration of the elevator car member, and at least one vibration damper for receiving an output signal from the at least one acceleration transducer and for damping vibration by imparting to the elevator car member a force acting in a direction opposite to the direction of the vibration and substantially simultaneous with the vibration, wherein the at least one vibration damper is mounted in parallel with the elastic suspension elements.

6. An apparatus according to claim 5, further comprising at least one amplifier for amplifying the output signal of the acceleration transducer before input to the at least one vibration damper.

7. An apparatus according to claim 6, wherein the at least one vibration damper includes at least one coil-and-armature structure.

8. An apparatus according to claim 5, wherein the at least one vibration damper includes at least one coil-and-armature structure.

9. In an elevator car supported by elastic suspension elements, an apparatus for damping the vibrations of an elevator car member, the apparatus comprising at least one acceleration transducer for measuring acceleration of the elevator car member, and at least one vibration damper for receiving an output signal from the at least one acceleration transducer and for damping vibration by imparting to the elevator car member a force acting in a direction opposite to the direction of the vibration and substantially simultaneous with it, further comprising at least one high-pass filter for filtering out, from the signal obtained from the acceleration transducer, signal components relating to the elevator's normal travelling acceleration, and, wherein the at least one vibration damper is mounted in parallel with the elastic suspension elements.

10. An apparatus according to claim 9, wherein the at least one vibration damper includes at least one coil-and-armature structure.

11. In an elevator car supported by elastic suspension elements, an apparatus for damping the vibrations of an elevator car member, the apparatus comprising at least one vibration damper for receiving an output signal from the at least one acceleration transducer and for damping vibration by imparting to the elevator car member a force acting in a direction opposite to the direction of the vibration and substantially simultaneous with the vibration, further comprising at least one high-pass filter for filtering out, from the signal obtained from the acceleration transducer, signal components relating to changes in the elevator's normal travelling acceleration, wherein the at least one vibration damper is mounted in parallel with the elastic suspension elements.

12. An apparatus according to claim 11, where the at least one vibration damper includes at least one coil-and-armature structure.

* * * * *